United States Patent [19]

Watanabe

[11] Patent Number: 4,630,921

[45] Date of Patent: Dec. 23, 1986

[54] COMBINED PRINTER-COPIER APPARATUS

[75] Inventor: Junji Watanabe, Yokohama, Japan

[73] Assignee: Kabushiki Kaisha Toshiba, Japan

[21] Appl. No.: 682,921

[22] Filed: Dec. 18, 1984

[30] Foreign Application Priority Data

Dec. 21, 1983 [JP] Japan ..... 58-241382

[51] Int. Cl.[4] ..... G03G 15/00

[52] U.S. Cl. ..... 355/3 SH; 355/3 R; 355/14 SH; 355/14 R; 346/76 PH

[58] Field of Search ..... 355/3 R, 14 R, 14 C, 355/4, 3 SH, 14 SH; 346/76 PH

[56] References Cited

U.S. PATENT DOCUMENTS

| | | | |
|---|---|---|---|
| 4,211,483 | 7/1980 | Hannigan et al. | 355/3 SH X |
| 4,309,101 | 1/1982 | Nakamura et al. | 355/3 R X |
| 4,345,835 | 8/1982 | Kramer et al. | 355/3 R |
| 4,453,841 | 6/1984 | Bobick et al. | 355/3 SH X |
| 4,469,433 | 9/1984 | Kurata et al. | 346/76 PH X |
| 4,517,590 | 5/1985 | Nagashima et al. | 346/76 PH X |
| 4,532,865 | 8/1985 | Yoshino | 346/76 PH X |
| 4,536,078 | 8/1985 | Ziehm | 355/3 SH X |

OTHER PUBLICATIONS

Andree et al, "Copier/Printer", *IBM Technical Disclosure Bulletin*, vol. 22, No. 2, Jul., 1979.

*Primary Examiner*—A. C. Prescott

*Attorney, Agent, or Firm*—Finnegan, Henderson, Farabow, Garrett & Dunner

[57] ABSTRACT

An image transferring apparatus functions both as a copying machine for forming a latent image of an original on a photosensitive body, developing it, and transferring it to sheets of paper or other material, and as a thermal transfer printer for transferring coloring agents to sheets of paper or other material in response to image information. The apparatus includes a feeding device that feeds sheets to either the copying machine or the printer for image transference. Further, one embodiment of the apparatus includes a conveying device for conveying a sheet that has been printed in the printer to an original holding board associated with the copying machine so that the image that was transferred to the sheet in the printer can be automatically copied onto additional sheets in the copying machine.

9 Claims, 19 Drawing Figures

COMBINED PRINTER-COPIER APPARATUS

BACKGROUND OF THE INVENTION

1. Field of the Invention

The present invention relates to an image building apparatus and more particularly to a combined structure of copying machine for building latent image of an original on a photosensitive body, developing it and transferring it to material to be image transferred and so-called image transfer type printer for transferring coloring agent of image transferring material to material to be image transferred in response to image information.

2. Description of the Prior Art

A copying machine of the type adapted to perform copying operation by way of the steps of building a latent image of an original on a photosensitive body, developing it in contact with a developing agent and transferring it to paper or the like material is well known. The conventional copying machine has advantageous features of high image resolvability, high processing speed and inexpensive manufacturing cost.

As to the so-called transfer type printer for transferring a coloring agent of image transferring material to material to be image transferred in response to image information, thermal transfer type image building apparatus is typically known. Image transferring material with a thermally fusible or vaporizable coloring agent coated thereon is usually employable for the thermal transfer type image building apparatus. Further, the recording head on the apparatus is constructed of a thermal head. As advantageous features of the thermal transfer type printer of small dimensions, inexpensive manufacturing cost, low level of noise and employment of plain paper as material to be image transferred are recognized increasingly, it is being used more and more in the recent years not only for the purpose of recording output from computors, word processors or the like but also as a recording device in a variety of structures. Another advantageous feature of the transfer type printer is that a digital signal is employable therefor.

However, it has been found that there is such a problem with the conventional system that when both functions of a copying machine and a transfer type printer are required, both copying machine and transfer type printer should be installed simultaneously because they are supplied separately. As a result, the conventional system is practiced at an expensive cost.

SUMMARY OF THE INVENTION

Thus, the present invention has been made with the foregoing background in mind and its object resides in providing an image building apparatus which functions as both a copying machine and a transfer type printer yet is arranged as a single unit and, moreover, can exhibit excellently high capability of image processing as will not be obtainable merely with individual arrangement of a copying machine and a transfer type printer.

To accomplish the above object there is proposed in accordance with the present invention an image building apparatus essentially comprising first image building means adapted to build a latent image of an original on a photosensitive body, develop it and transfer it to first or second material to be image transferred, second image building means adapted to transfer a coloring agent of image transferring material to the second or first material in response to image information, first feeding means for feeding the first material to be image transferred, second feeding means for feeding the second material to be image transferred and guiding means for selectively guiding to the first or second image building means the first or second material fed from the first or second feeding means.

According to an embodiment of the invention the apparatus includes an original conveying device on the original holding board so that material to which an image has been transferred in the second image building means is conveyed to the original holding means by means of the original conveying device and an image is built on another material to be image transferred by means of the first image building means.

Since the apparatus of the invention is constructed to function as both a copying machine and a printer arranged as a single unit, it has characterizing features of inexpensive manufacturing cost, minimized space required for installation, increased number of kinds of material to be image transferred and possibility of transference of a printed image to another material to be image transferred.

Other objects, features and advantages of the present invention will become more clearly apparent from reading of the following description which has been prepared in conjunction with the accompanying drawings.

BRIEF DESCRIPTION OF THE DRAWINGS

The accompanying drawings will be briefly described below.

FIG. 1 is a perspective view of the electrographic copying machine.

FIG. 2 is a vertical sectional side view of the electrographic copying machine.

FIG. 3 is a fragmental sectional side view of the electrographic copying machine with a thermal transfer printer removed therefrom.

FIG. 4 is a view schematically illustrating the gate control system.

FIG. 5 is a vertical sectional side view of the image transferring section, shown in an enlarged scale.

FIG. 6 is a perspective view schematically illustrating operation of image transference.

FIG. 7 is a plan view illustrating how ink is coated on the thermal transfer ribbon.

FIG. 8 is a block diagram illustrating essential components constituting the machine.

FIG. 9 is a fragmental perspective view of the machine particularly illustrating spaced arrangement of a thermal head and a ribbon guide relative to the platen.

FIG. 10 is a perspective view of the machine particularly illustrating how the head holder is supported for the thermal head.

FIG. 11 is a perspective view of the machine particularly illustrating how driving systems are arranged for the platen, the thermal transfer ribbon and the thermal head.

FIG. 12 is a schematic side view of the machine particularly illustrating how the thermal head comes in contact or out of contact with the platen.

FIG. 13 is a schematic perspective view of the machine particularly illustrating how the ribbon cassette is fitted to the cassette case.

FIG. 14 is a schematic side view of the machine particularly illustrating how paper is transported therethrough during copying and printing.

FIG. 15 is a schematic side view of the machine particularly illustrating how paper is transported therethrough during copying.

FIG. 16 is a vertical sectional side view of the machine particularly illustrating that it has a thermal transfer type printer unit incorporated therein.

FIG. 17 is a fragmental sectional side view of the machine particularly illustrating control system for the thermal transfer type printer unit.

FIG. 18 is a vertical sectional side view of the machine particularly illustrating that paper with image transferred thereto in the thermal transfer type printer unit is transported to the original holding board, and FIG. 19 is a vertical sectional side view of the machine particularly illustrating that paper with image transferred thereto in the thermal transfer type printer unit is discharged onto the paper discharging tray.

DESCRIPTION OF THE PREFERRED EMBODIMENTS

Now, the present invention will be described in a greater detail hereunder with reference to the accompanying drawings which illustrate preferred embodiments thereof.

Figure 1:
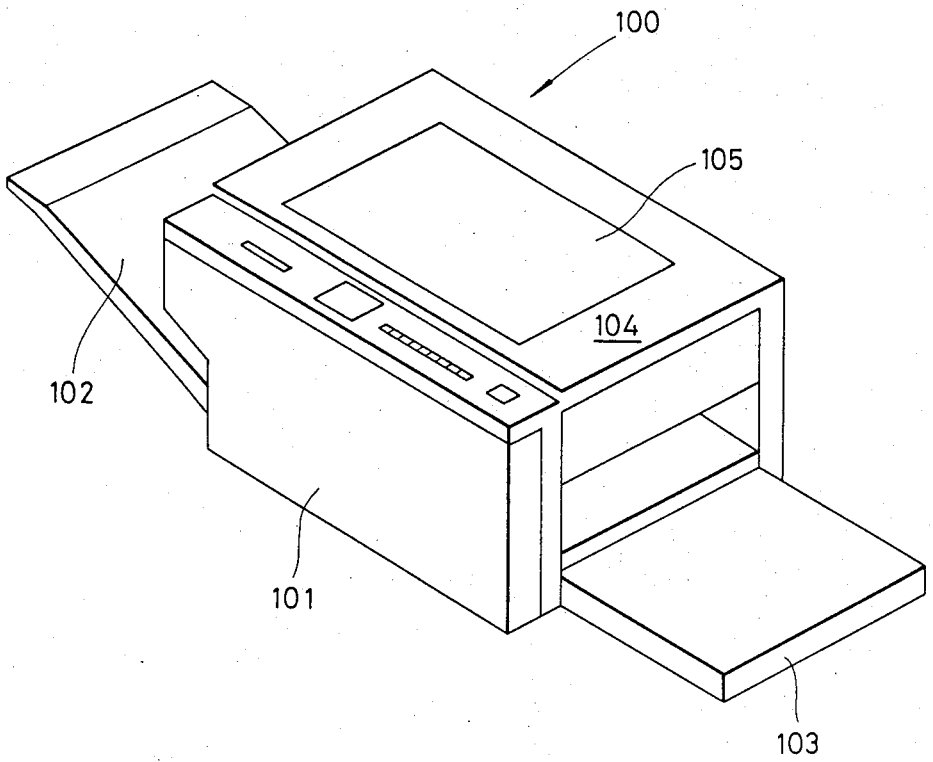
FIGS. 1 to 15 illustrate an electrographic copying machine in accordance with an embodiment of the invention.
Figure 2:
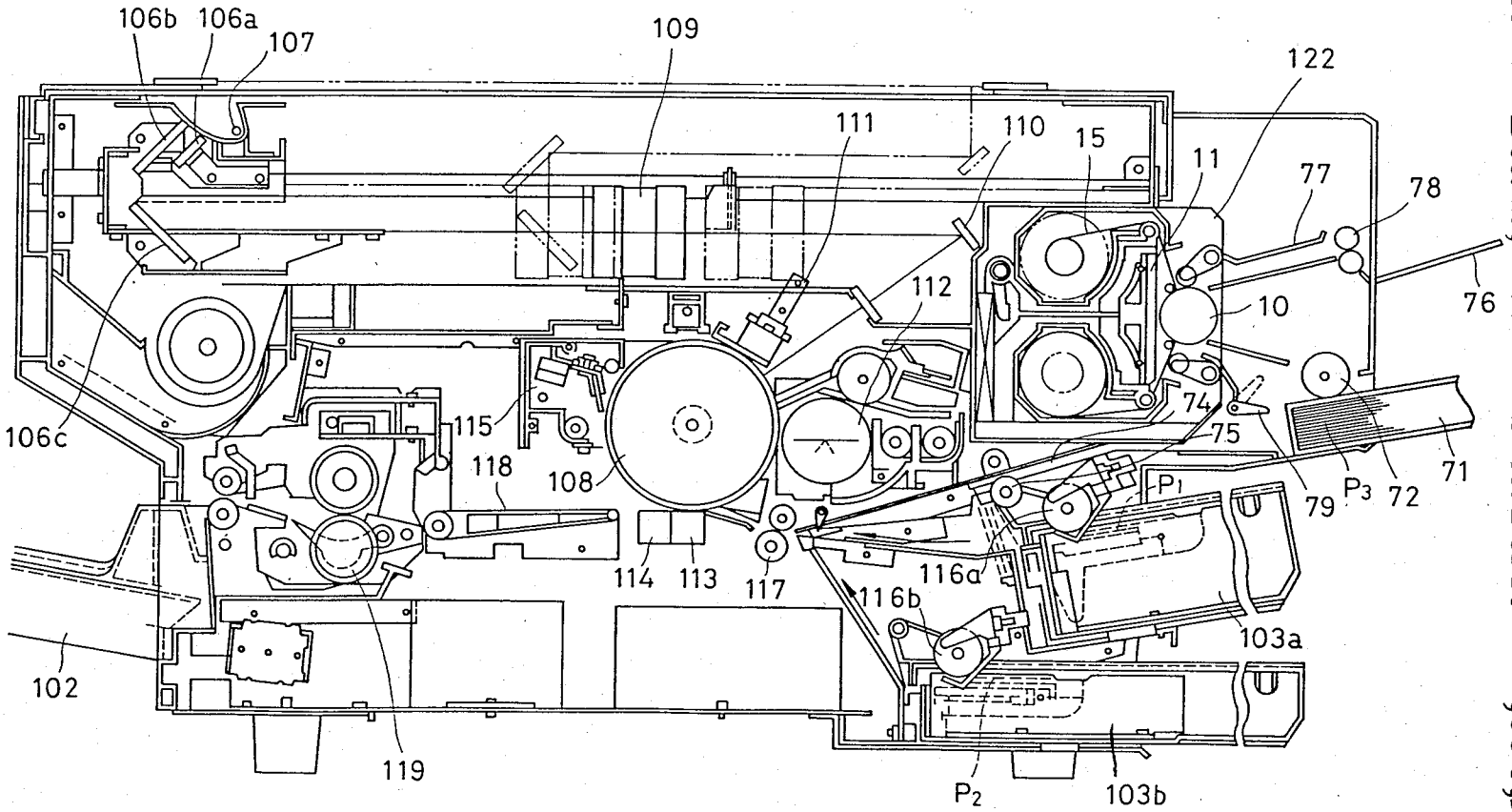
Figure 3:
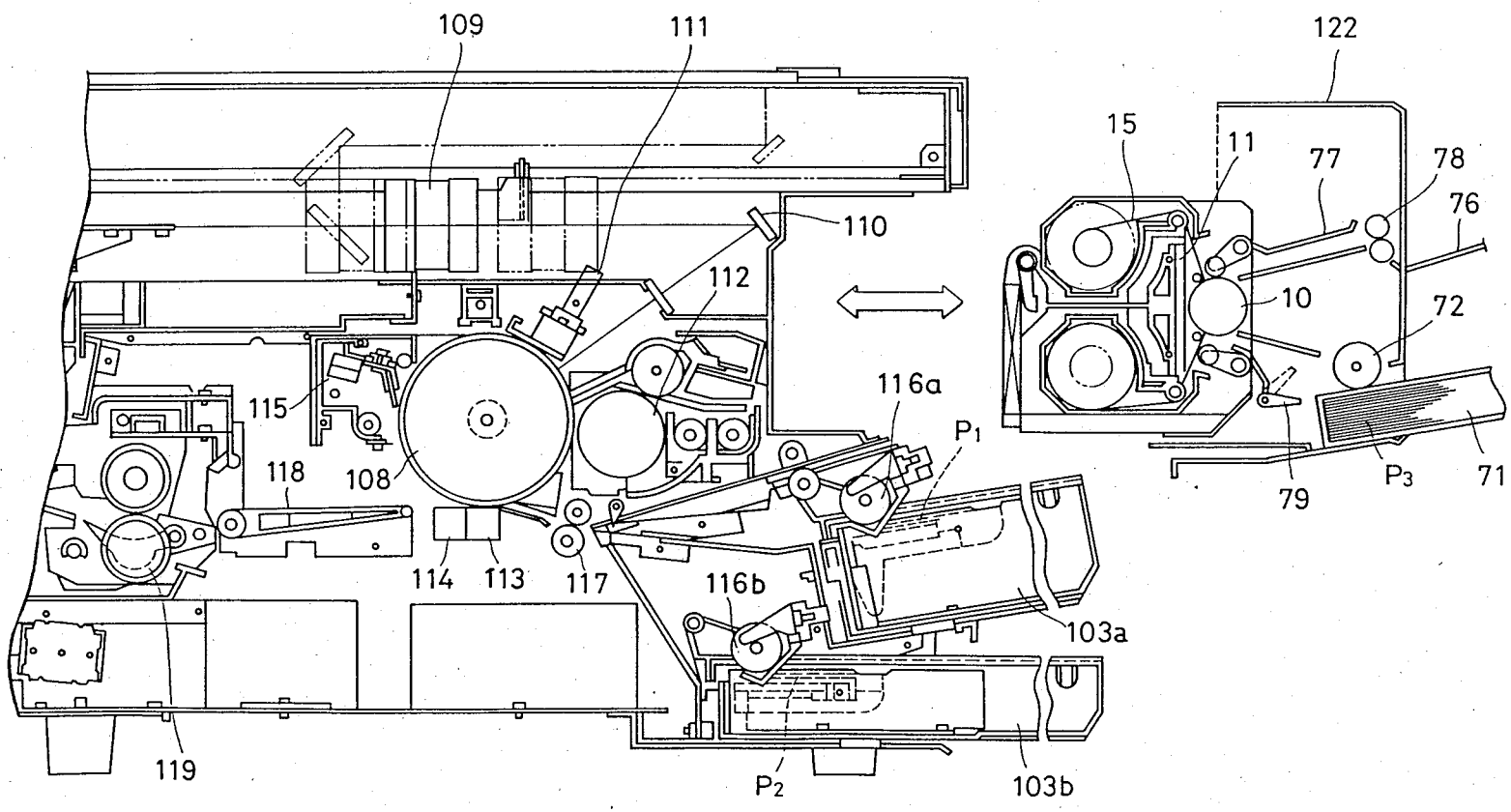

In FIGS. 1 to 15 reference numeral 101 designates a housing of copying machine 100, which includes an electrostatic copier as first image building means. The housing 101 is detachably provided with a tray 102 on the one side, whereas (see FIG. 2) it is provided with a first cassette **103*a* and a second cassette 103*b* on the other side thereof, both the cassettes 103*a* and 103*b* serving as feeding means with papers $P_1$ and $P_2$ received therein as first material to be image transferred. It should be noted that the paper $P_1$ is dimensioned to A4 size and the paper $P_2$ is to A3. Further, reference numeral 104 designates a stationary original holding board or surface on which an original 105 is placed. The original 105 is scanned by means of a combination of mirror 106*a* and lamp 107. Mirrors 106*b* and 106*c* are adapted to reciprocably move in synchronization with rotation of a photosensitive drum 108 so as to keep the length of light beam passage constant. The original 105 is lighted by the lamp 107 and the image carried thereon is transmitted onto the photosensitive drum 108 via lens 109 and mirror system 110 to build a latent image on the surface of drum 108 that corresponds to the image on the original 105. Further, charger 111, developer 112, transfer charger 113, scraping charger 114 and cleaning device 115 are arranged in the area located in the proximity of the photosensitive drum 108 in accordance with the order as seen in the direction of rotation of the latter. The surface of the photosensitive drum 108 is uniformly charged by means of the charger 111 so that a latent image is built thereon. This latent image is developed in contact with a developing agent in the developer 112**.

Paper $P_1$ or $P_2$ is taken from the first or second cassette **103*a* or 103*b* with the aid of paper feeding roller 116*a* or 116*b* to be delivered to a pair of regist rolls 117. The position of paper $P_1$ or $P_2$ is correctly control adjusted by means of the regist rolls 117 and thereafter it is transported to the lower part of the photosensitive drum 108 so that, the latent image on the latter is transferred to the paper with the aid of the transfer charger 113. On completion of image transference on paper $P_1$ or $P_2$ the latter is transported by means of a transporting belt conveyor 118 to a fixing device 119, in which the image is fixed on the paper. Then, the paper is discharged on a discharging tray 102**.

After completion of image transference the photosensitive drum 108 is cleaned with the aid of the cleaning device 115, and it is then caused to turn back to the charger 111.

Figure 5:
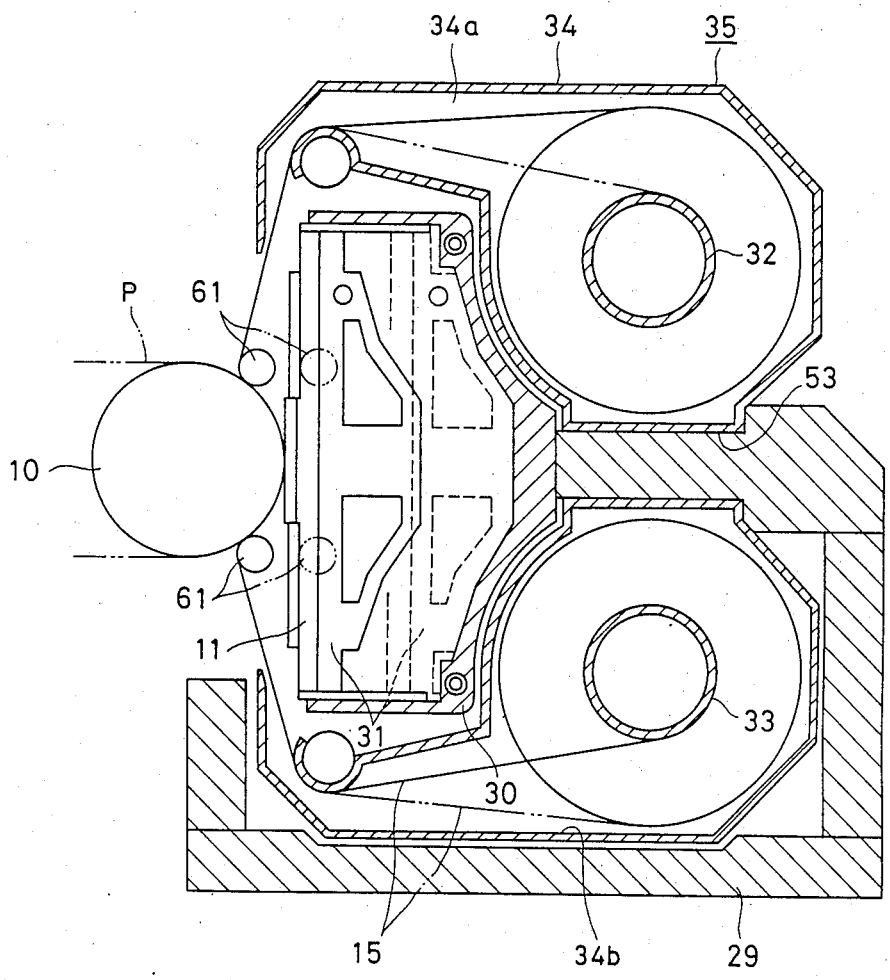

Further, a thermal transfer type printer unit 122 serving as second image building means is detachably arranged at the position located upwardly of the first cassette **103*a* in the housing 101. The thermal transfer type printer unit 122 is constructed as illustrated in FIG. 5. Specifically, in the drawing reference numeral 10 designates a platen which is located opposite to a thermal head 11 serving as a recording head. The platen 10 is adapted to come in contact or out of contact with the thermal head 11**.

Between the thermal head 11 and the platen 10 is extended a thermal transfer ribbon (ink ribbon 15) which serves as transfer material. As paper P is thrust against the platen 10 while the thermal transfer ribbon 15 is interposed therebetween and heating elements (not shown) arranged in the line-dot shaped configuration on the thermal head 11 are caused to heat up in response to image information, coloring agent (ink) on the thermal transfer ribbon 15 is molten made and it is then transferred to paper P to form an information-based image on paper P.

Figure 6:
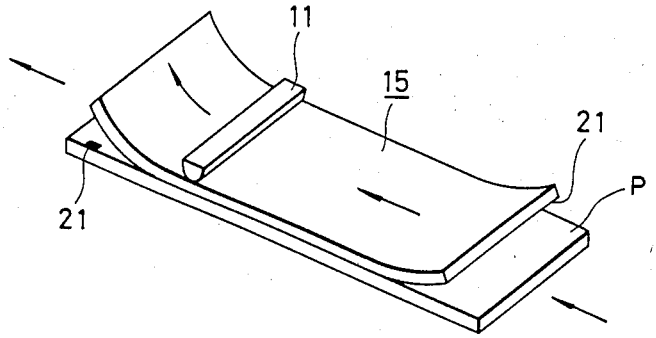

On the other hand, the thermal head 11 thrusts paper P against the platen 10 with the thermal transfer ribbon interposed therebetween so that ink 21 on the thermal transfer ribbon 15 serving as a coloring agent is transferred to paper P in the molten state, as schematically illustrated in FIG. 6.

Figure 7:
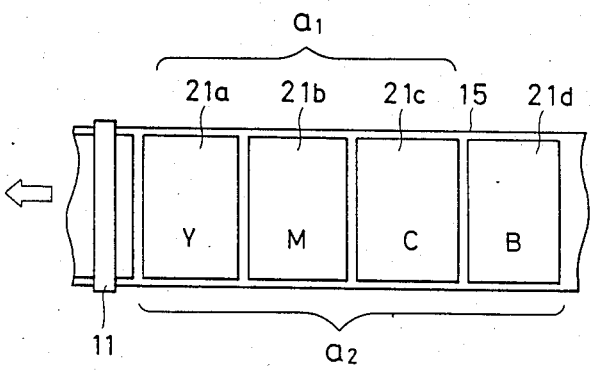

The thermal transfer ribbon 15 has three ink sections **21*a*, 21*b* and 21*c* arranged one after another, the ink section 21*a* being allocated to yellow (Y), the ink section 21*b* being to magenta (M) and the ink section 21*c* being to cyan (C) and they having the substantially same size as that of paper P, as identified by the area $a_1$ in FIG. 7. Alternatively, it has four ink sections 21*a*, 21*b*, 21*c* and 21*d* arranged one after another, the ink section 21*a* being allocated to yellow (Y), the ink section 21*b* being to magenta (M), the ink section 21*c* being to cyan (C) and the ink section 21*d*** being to black (B), as identified by the area $a_2$ in the drawing. Paper P is restored to the original position every time when one color is transferred thereto and the same step of transferring is repeated by the number of ink sections strictly in accordance with the predetermined order of superimposing.

The type of thermal transfer ribbon with black ink section **21*d* added thereto is intended to be in use for the case where black color is required to appear clearly. However, black color can be substantially created without any use of black ink section 21*d*** by superimposing other three colors one above another.

Figure 8:
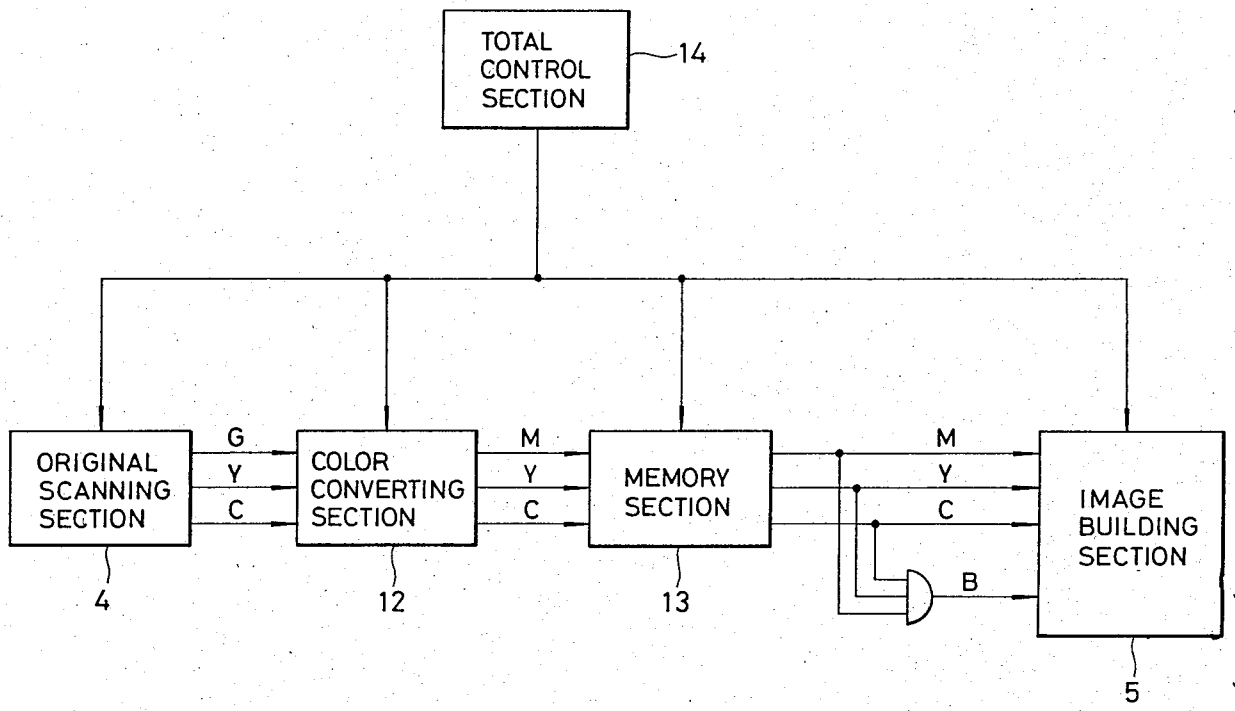

The second image building means is constructed by a combination of original scanning section 4, color converting section 12, memory section 13, image building section 5 and total controlling section 14, as schematically illustrated in FIG. 8.

Specifically, the value of each of color components comprising green (G), yellow (Y) and cyan (C) detected by the original scanning section 4 is converted into magenta (M), yellow (Y) and cyan (C) constituting printing medium in the color converting section 12 and the thus converted value is stored together with information concerning the position on the original in the storing section 13 with respect to each of the colors. The value is then read out of the memory section 13 so that printing medium constituted by magenta (M), yellow (Y), cyan (C) and black (B) (in this case black represents AND output from magenta (M), yellow (Y) and cyan (C)) is transferred to paper P in the image building section 5. Incidentally, the total control section 14 is adapted to control all of the original scanning section 4, the color converting section 12, the memory section 13 and the image building section 5.

Further, as illustrated in more detail in FIG. 5, the thermal head 11 is fixedly secured to a head holder 31 serving also as heat radiating disc of which rear part is surrounded by a member 30 which is attached to the frame block 29. As is apparent from the drawing, the thermal transfer ribbon 15 is assembled with winding cores 32 and 33 in the form of a cassette, the winding cores 32 and 33 allowing both the ends of the thermal transfer ribbon 15 to be wound thereabout, and the ribbon cassette 35 is detachably mounted on the frame block 29. The latter is die cast or molded of plastic material or the like in an integral structure having a substantially U-shaped cross-sectional configuration to assure sufficiently high mechanical strength. Positioning accuracy of the ribbon cassette 35 can be increased by fitting the one winding core receiving portion constituting the ribbon cassette 35 to the U-shaped structure as described above.

Figure 9:
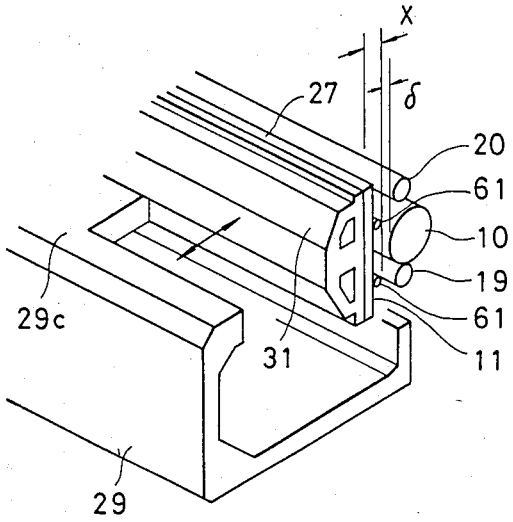

Further, as illustrated in FIG. 9, the head holder 31 with the thermal head 27 attached thereto is adapted to move by a distance X in the direction of coming in contact or out of contact with the platen 10. As required, a clearance $\delta$ can be formed between the ribbon guides 61 and the platen 10 so as to allow the thermal transfer ribbon 15 to be inserted therethrough. Thus, reciprocable movement of paper P and attaching and detaching operation of the ribbon cassette 35 can be easily and reliably carried out.

Figure 10:
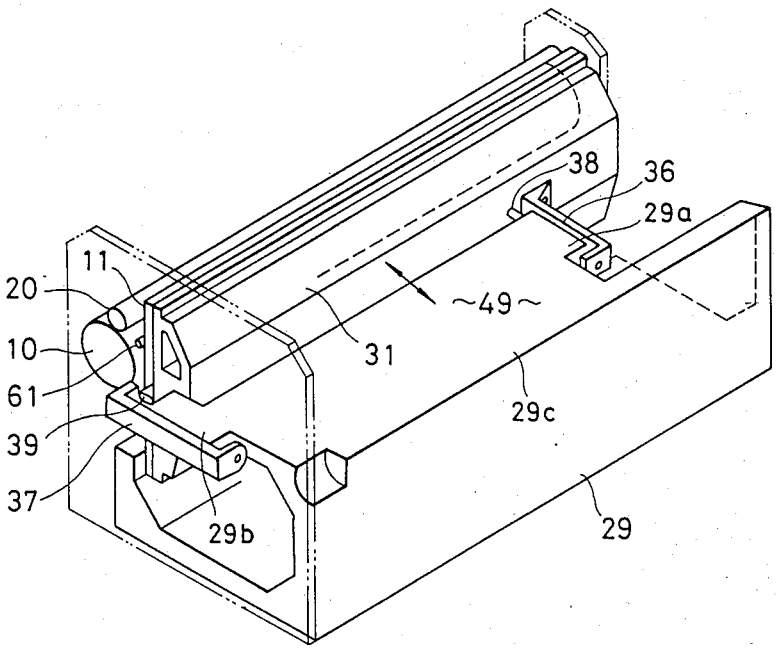
Figure 11:
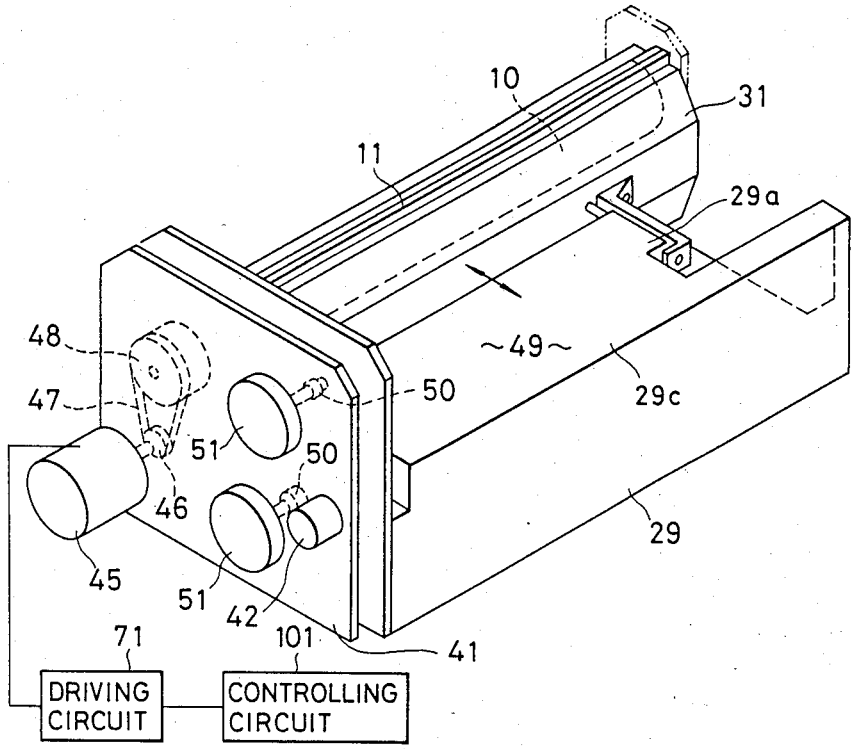

Specifically, as illustrated in FIGS. 10 and 11, guide shafts 38 and 39 are secured to the head holder 31 with the aid of stays 36 and 37 so that the middle part of the guide shafts 38 and 39 is carried by linear bearings fitted into the bearing portions **29*a* and 29*b* of the frame block 29**.

Figure 12:
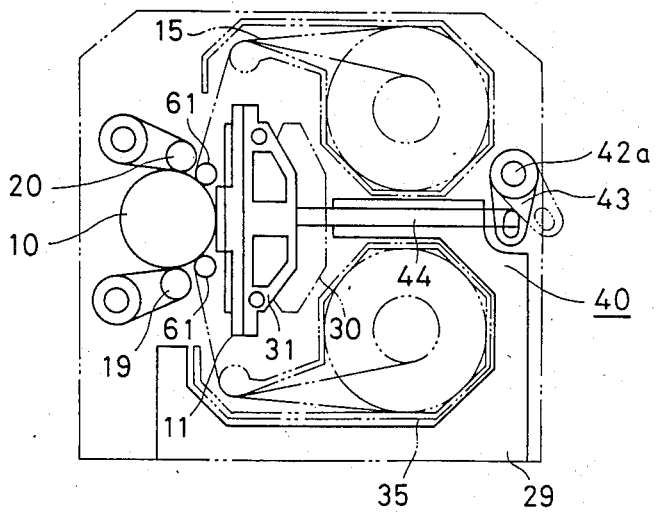

The thus reciprocably supported head holder 31 is controlled by means of a head displacement mechanism 40 so as to come in contact or out of contact with the platen 10. As illustrated in FIG. 11, a motor 42 for the thermal head is mounted on the frame 41 and as illustrated in FIG. 12, an arm 43 is secured to the driving shaft **42*a* of the motor 42. The one end of the arm 43 is operatively connected to the other end of the connecting rod 44 attached to the head holder 31 so that turning movement of the arm 43 is transmitted to the head holder 31** in the form of reciprocal movement.

As illustrated in FIG. 11, the motor frame 41 with the motor 42 mounted thereon for the thermal head further carries for the platen a motor 45 in the form of a pulse motor and driving force generated by the motor 45 is transmitted to the platen 10 via the power transmission mechanism comprising pulley 46, belt 47 and pulley 48 so as to displace it in the normal or reverse direction. Further, the frame 41 carries a pair of motors 51 for the ribbon at the position which is determined corresponding to the cassette fitting section 49 where the ribbon cassette 35 is fitted to the thermal transfer printer. As is apparent from the drawing, each of the motors 51 is provided with a coupling 50 on their driving shaft.

Figure 13:
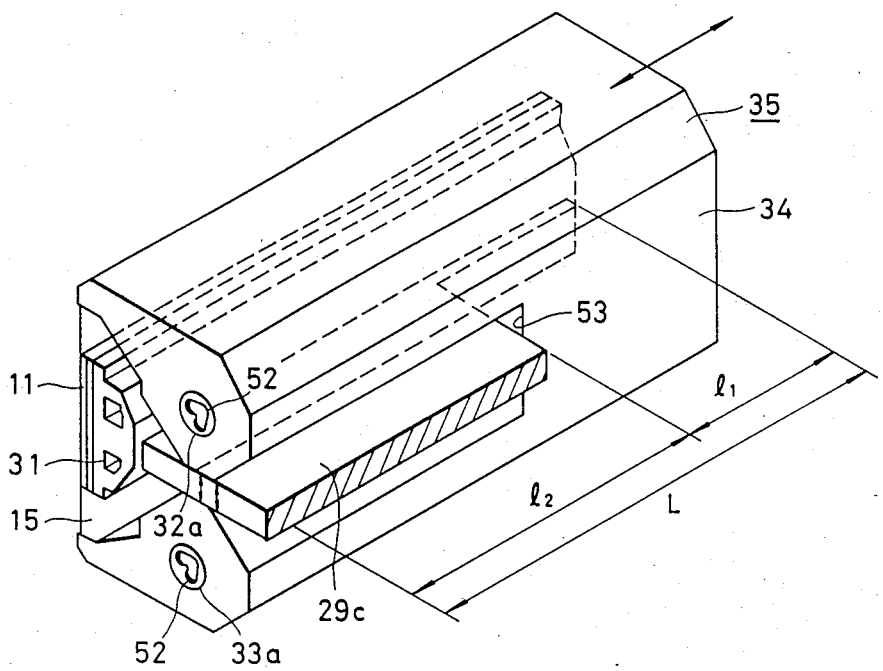

On the other hand, the winding cores 32 and 33 for winding thereabout both the ends of the thermal transfer ribbon 15 in the ribbon cassette 35 include driving power receiving end portion **32*a* and 33*a* which are exposed to the outise via punched holes on the wall surface of the case 34, the driving power receiving end portions 32*a* and 33*a* being formed with engagement recesses 52 on their foremost end as illustrated in FIG. 13**.

When the ribbon cassette 35 is completely fitted at the predetermined position, the couplings 50 are caused to come in engagement to the engagement recesses 52 on the winding cores 32 and 33. Thus, the thermal transfer ribbon 15 is ready to be wound.

As is apparent from FIGS. 5 and 12, the ribbon cassette 35 includes two winding cores 32 and 33 extending in parallel with one another so as to allow both the ends of the thermal transfer ribbon 15 to be anchored thereat and the latter is housed in the case 34 in such a manner that a part thereof is exposed to the outside at the position located between the platen 10 and the thermal head 11.

Between winding core receiving portions **34*a* and 34*b* on the case 34 is formed a slit 53 which extends in the axial direction of the winding cores 32 and 33 to be opened on the one end side. The driving force receiving end portions 32*a* and 33*a* of the winding cores 32 and 33 are located on the opened end side of the slit 53**.

Further, as illustrated in FIGS. 5, 12 and 13, the case 34 of the cassette 35 is designed in the substantially U-shaped cross-sectional configuration to form the hollow space in which the member 31 and the thermal head 11 attached to the latter are housed at the position between the exposed part of the thermal transfer ribbon 15 and the case 34.

The width of the thermal transfer ribbon 15 is dimensioned larger than the maximum winding diameter obtainable by the winding cores 32 and 33 and the cut depth of the slit 53 is dimensioned more than half of the width of the thermal transfer ribbon 15.

Thus, the whole length L of the case 34 defining the ribbon cassette 35 is constituted by two portions, one of them being an area having a length $l_1$ of which both upper and lower parts are jointed to one another and the other one being an area having a length $l_2$ which is divided into upper and lower parts with the slit 53 being located therebetween. The width $t_2$ of the slit 53 is dimensioned appreciably larger than the thickness of the cassette fitting portion **29*c* of the frame block 29**.

When the ribbon cassette 35 is to be mounted, the end face of the cassette fitting portion **29*c* is located opposite to the opened end face on the slit 53 and the ribbon cassette 35 is displaced forward in the longitudinal direction thereof (in the axial direction of the platen) until the cassette fitting portion 29*c* is engaged to the slit 53 as illustrated in FIG. 13**. On the contrary, when it is to be dismounted, operation is performed in the reverse direction.

On the other hand, the thermal transfer type printer unit 122 is detachably provided with a third cassette 71 serving as paper feeding means in which a number of papers $P_3$ having A4-R size are received as second material to be image transferred. Papers $P_3$ are taken out of the third cassette 71 one by one by rotation of the paper feeding roller 72 to be delivered to the thermal head 11. Further, a gate 79 serving as guide means is turnably disposed at the position located forwardly of the third cassette 71. When the gate 79 is turned to the position shown by the dotted lines in FIG. 2, paper $P_3$ is selectively transported to the regist roller 117 by means of the feeding roller 75 via the guide passage 74 and it is then transported to the lower part of the photosensitive drum 108 via the regist roller 117. The paper discharging tray 76 is disposed above the third cassette 71 so that paper $P_3$ to which image has been already transferred in the thermal transfer type printer unit 122 is discharged onto the paper discharging tray 76 via the discharging passage 77 and the paper discharging roller 78.

Figure 4:
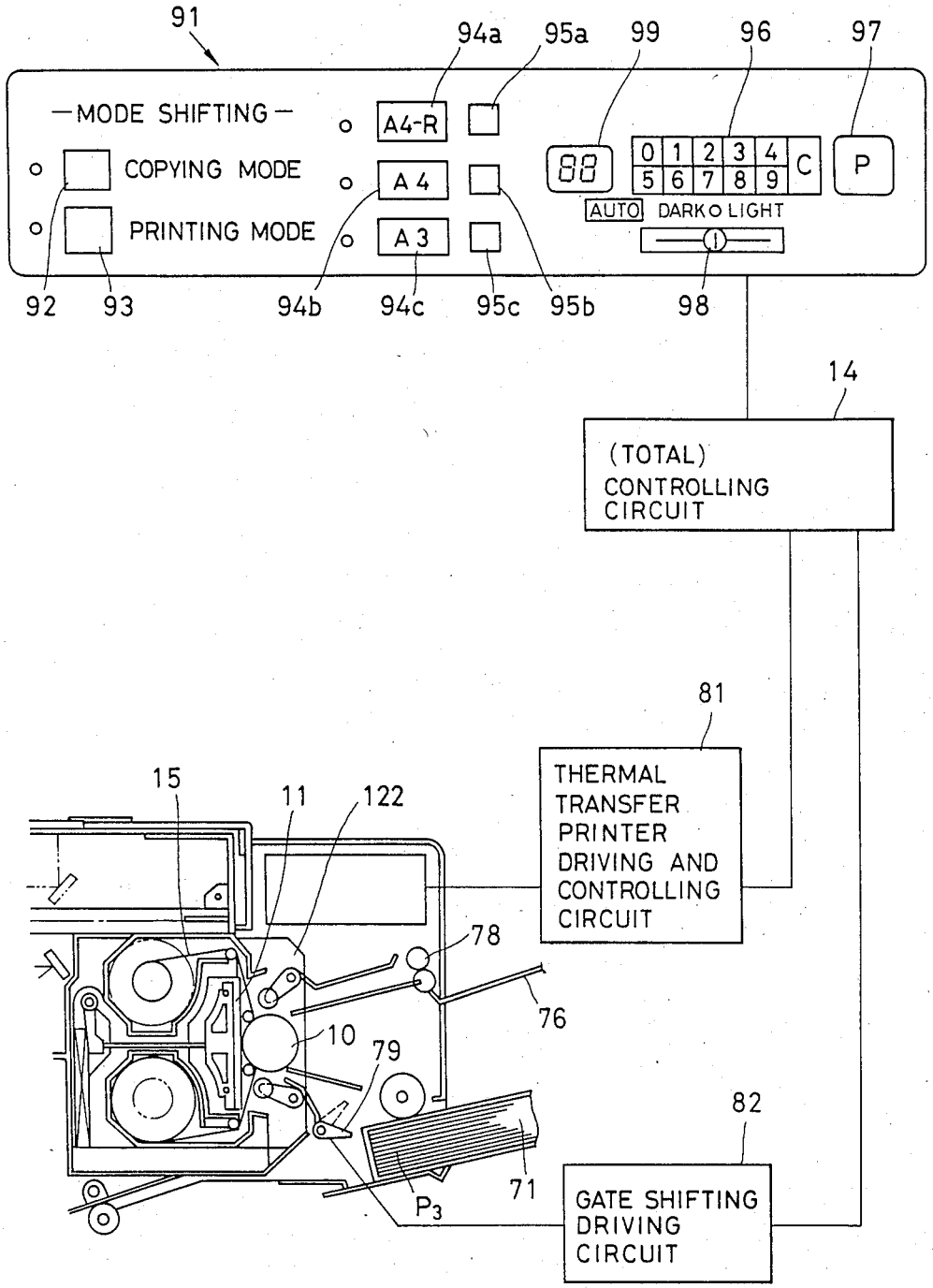

The housing 101 of the copying machine carries a control section 91 on the upper surface therof as illustrated in FIG. 4. As is apparent from the drawing, a copying mode button 92 and a printer mode button 93 are arranged on the one side for the purpose of shifting mode of operation, cassette selection keys 94*a*, 94*b* and 94*c* and display lamps 95*a*, 95*b* and 95*c* are arranged on the central part and a paper number determining button 96, a start button 97, an optical density adjusting lever 98 and a paper number display section 99 are arranged on the other side of the control section 91. The latter is electrically connected to a driving control circuit 81 for the thermal transfer printer and a driving circuit 82 for the gate shifting magnet via the total control circuit 14.

When the printer mode button 93 is turned on, the gate 79 is turned to the position as identified by real lines in FIG. 4 so that paper $P_3$ delivered from the third cassette 71 is introduced to the thermal head 11. When the copying mode button 92 is turned on and the cassette selection key 94*a* is turned on for A4-R size, the gate 79 is turned to the position as identified by dotted lines in the drawing so that paper $P_3$ is fed to the photosensitive drum 108 via the guide passage 74.

Next, when the operator depresses the copying mode botton 92 and the A4 size selection botton 94*b*, paper $P_1$ is taken from the first cassette 103*a* as the paper feeding roller 106*a* rotates and it is then delivered to the regist roller 117 at which the position of paper $P_1$ is corrected. Thereafter, it is transported to the photosensitive drum 108 at which image is transferred to it. Next, it is fixed at the fixing device 119 and it is then discharged onto the paper discharging tray 102.

When the copying mode button 92 is turned on and the A3 size selection button 94*c* is turned on, paper $P_2$ is taken from the second cassette 103*b* as the paper feeding roller 106*b* rotates and it is then delivered to the regist roller 117 at which the position of paper $P_2$ is corrected. Thereafter, it is transported to the photosensitive drum 108 at which image is transferred to it. Next, it is fixed at the fixing device 119 and it is then discharged onto the paper discharging tray 102.

When the copying mode button 92 is turned on and the A4-R size selection button 94*a* is turned on, paper $P_3$ is taken from the third cassette 71 as the paper feeding roller 72 in the thermal transfer type printer unit 122 rotates while the gate 79 is turned to the position as identified by dotted line in FIG. 4, so that it is delivered to the regist roller 117 via the guide passage 74 and it is further delivered to the photosensitive drum 108 via the regist roller 117 at which image is transferred to paper $P_3$. Next, it is fixed at the fixing device 119 and it is then discharged onto the paper discharging tray 102.

Figure 14:
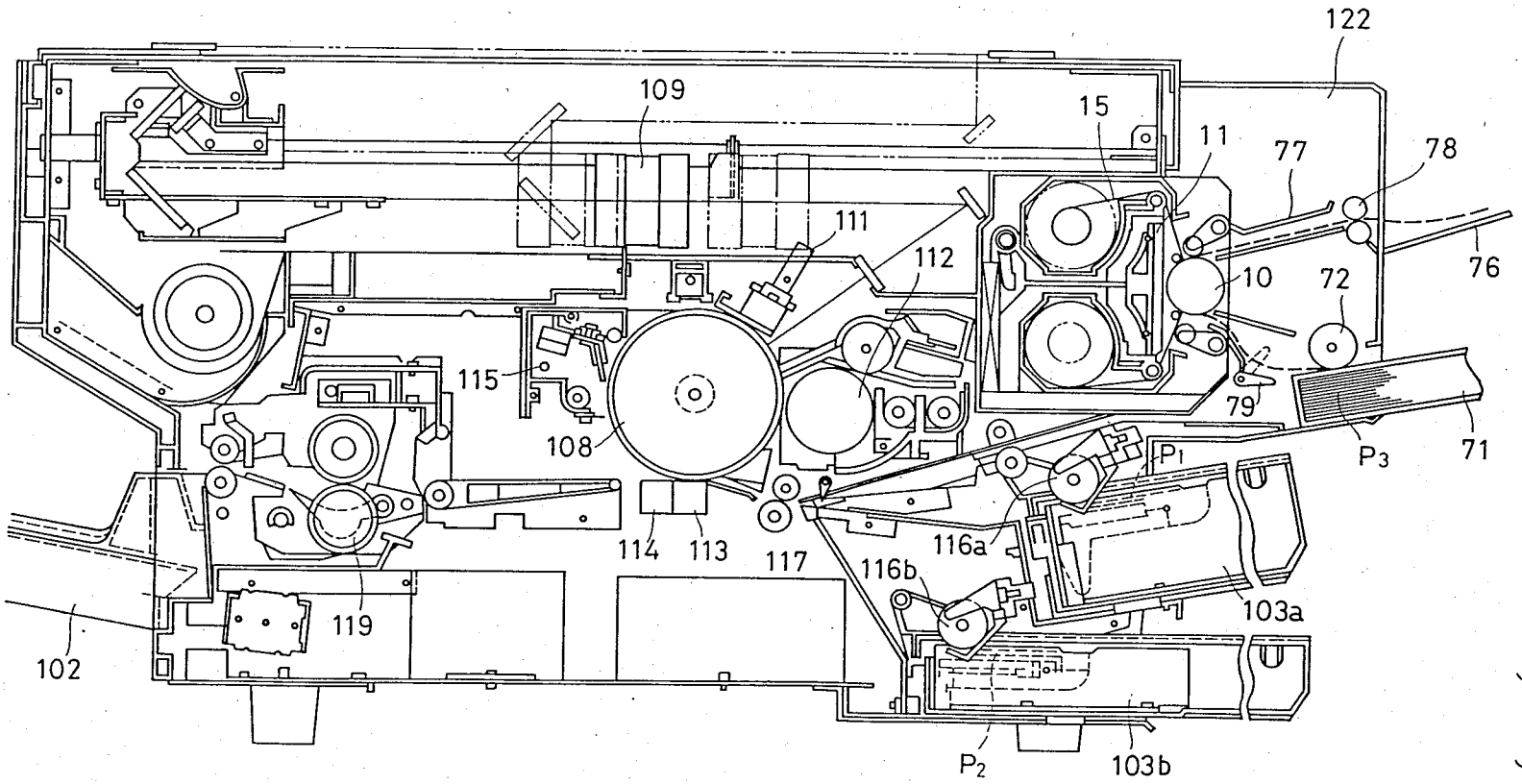
Figure 15:
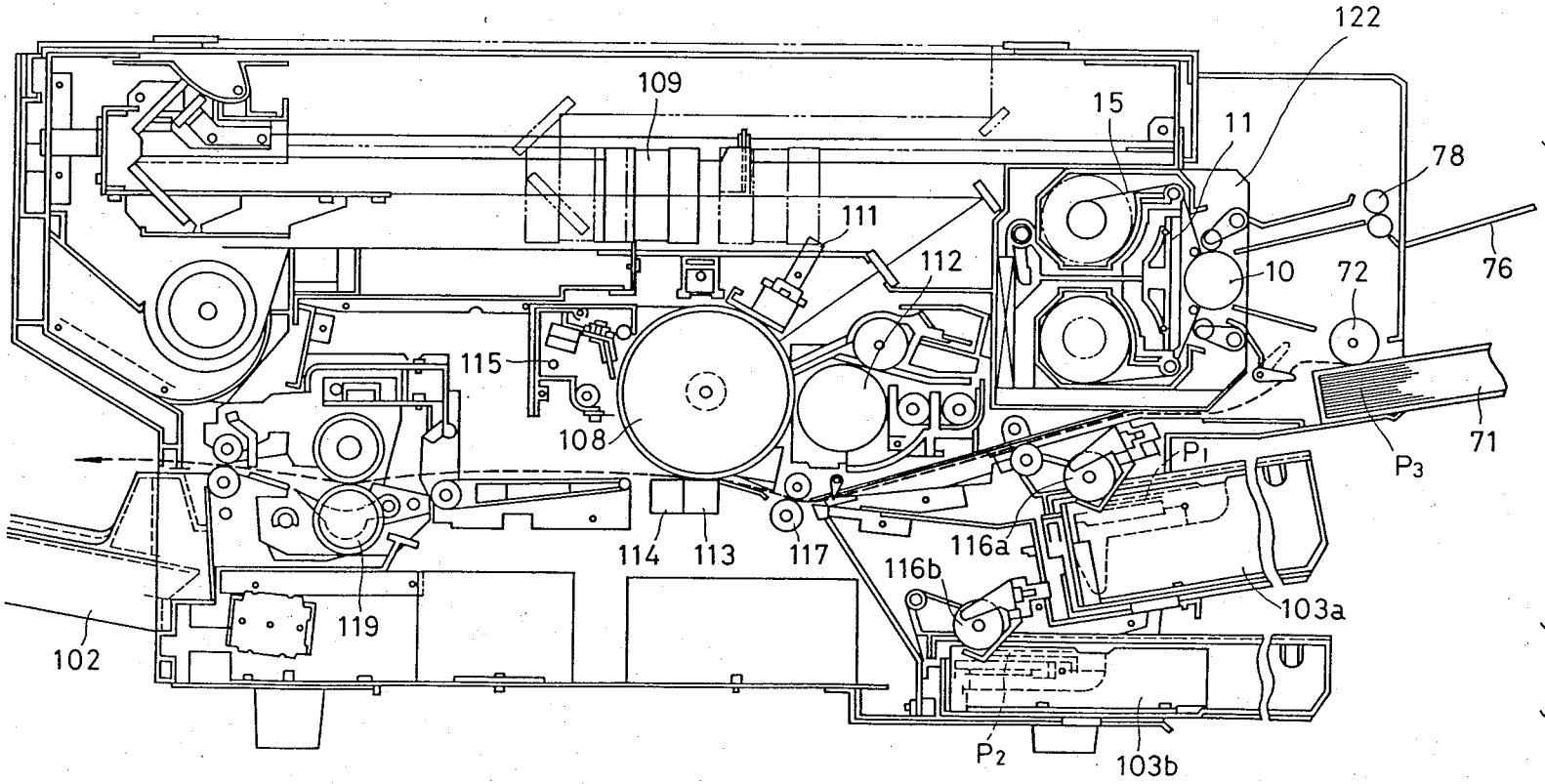
Figure 16:
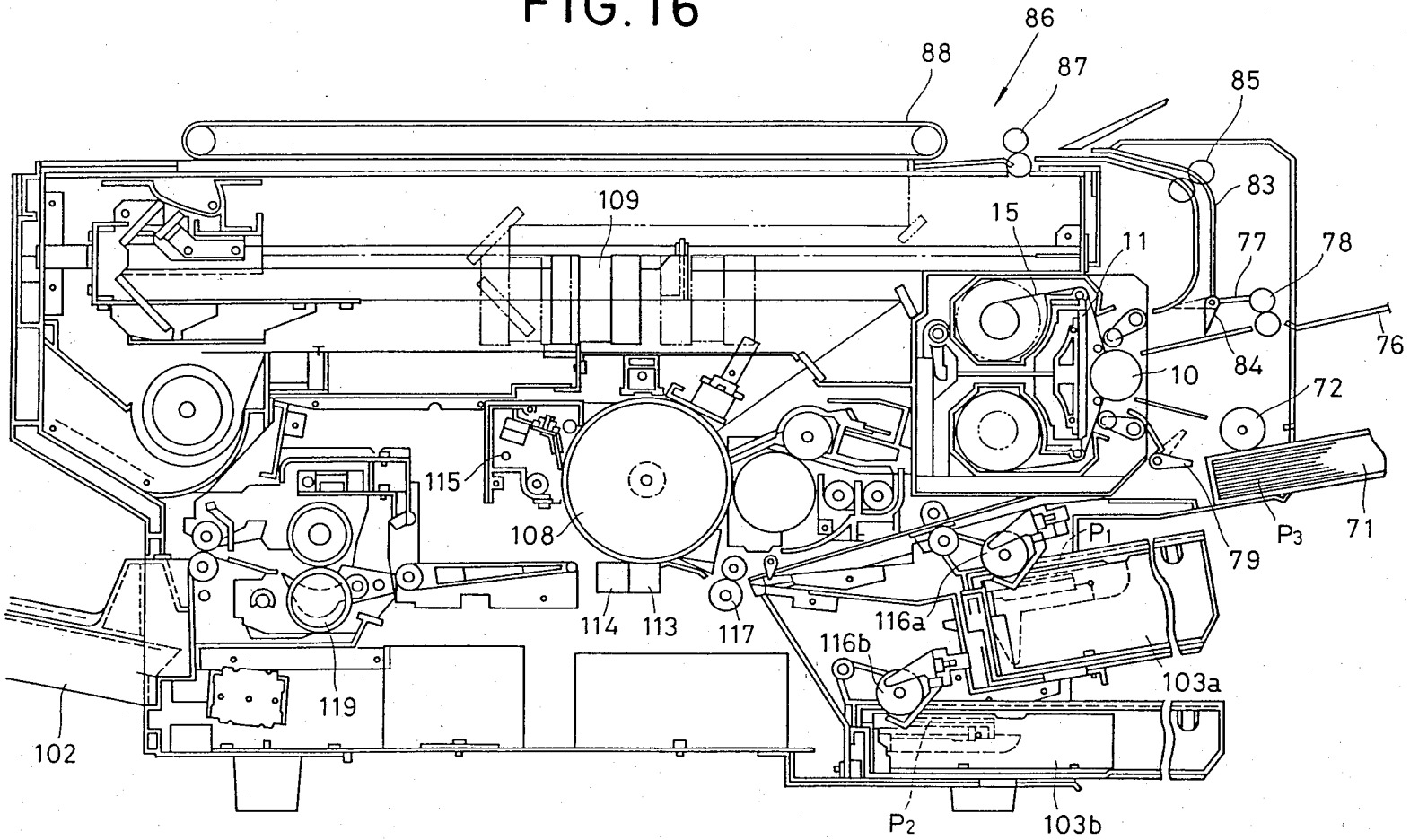
FIGS. 16 to 19 illustrate an electrographic copying machine in accordance with another embodiment of the invention.
Figure 17:
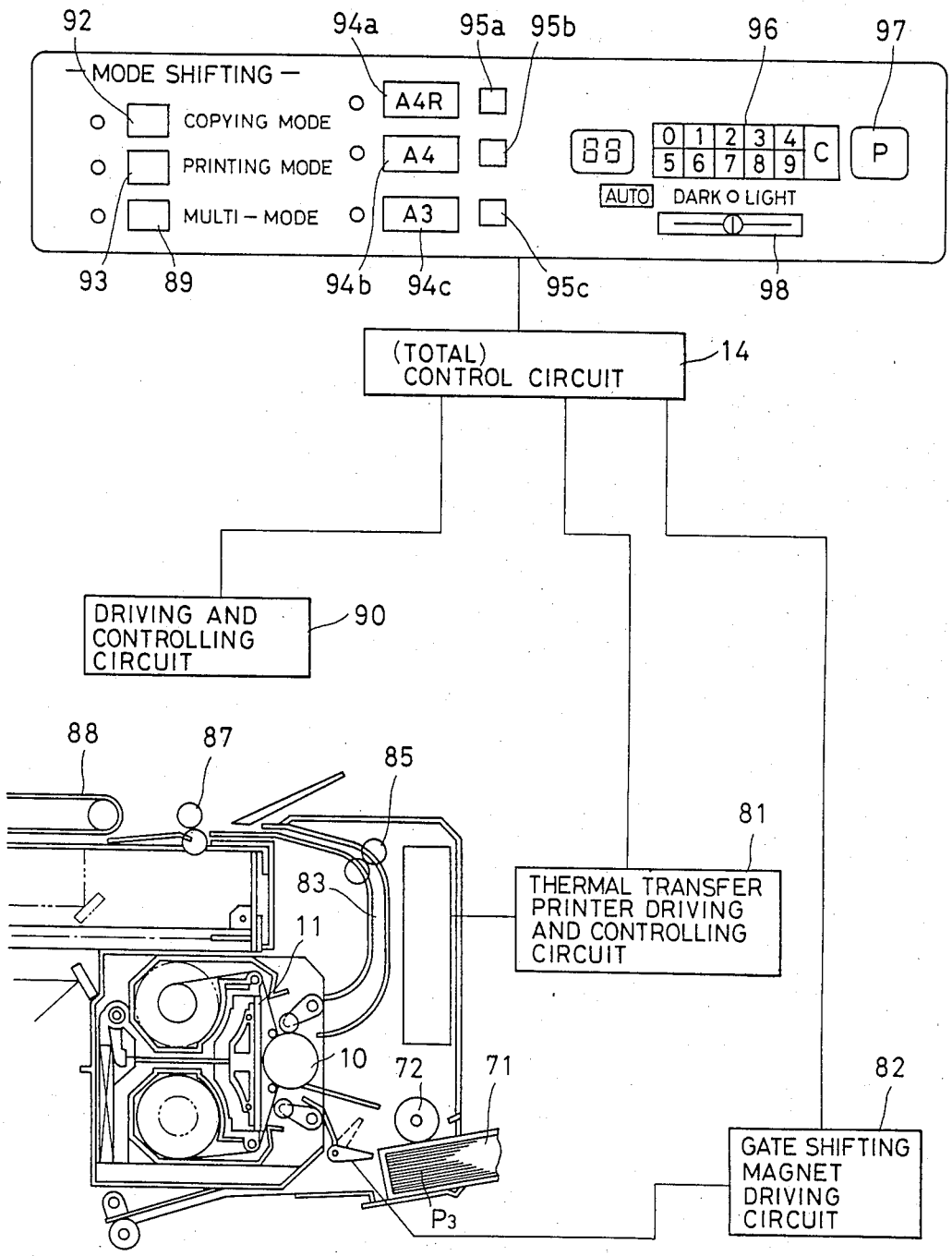
Figure 18:
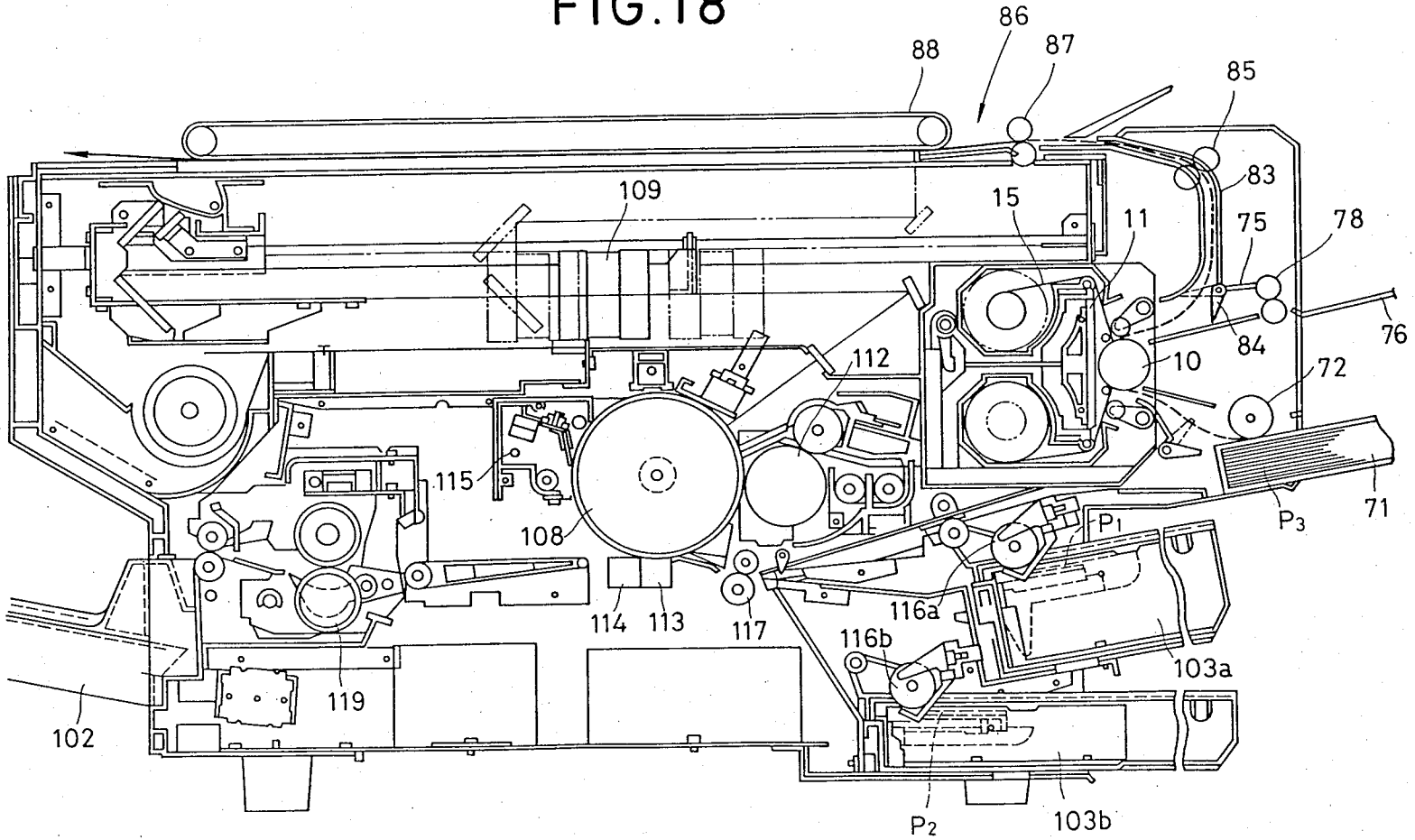

When the printer mode button 93 is turned on and the A4-R size selecting button 94*a* is turned on, paper $P_3$ is taken from the third cassette 71 as the paper feeding roller 72 while the gate 79 is turned to the position as identified by real lines in FIG. 14, so that it is delivered to the thermal head 11 via the passage as identified by a dotted line in the drawing at which image is transferred to paper $P_3$ in response to image informations. Next, it is discharged onto the paper discharging tray 76 via the paper discharging passage 77 and the paper discharging roller 78.

As described above, the apparatus of the invention functions both as copying machine and printer merely by arrangement of a single unit and therefore it can be manufactured at an inexpensive cost with necessity for reduced space required for installation, compared with the case where copying machine and printer are supplied and installed separately.

Since paper $P_3$ in the third cassette 71 for the thermal transfer type printer unit 122 can be selectively fed to the photosensitive drum 108, the number of kinds of papers usable for the compound copying machine can be increased as required.

When paper $P_3$ which has been discharged out of the apparatus with a certain image transferred thereto in the thermal transfer type printer unit 122 is placed on the original holding board 104 to be copied, it is possible for the apparatus to displace thus thermally transferred image to paper $P_1$ or $P_2$. This means that a large number of papers can be printed with a desired image by utilizing processing capability of a copying machine at a higher operative speed.

Further, since the thermal transfer type printer unit 122 is detachably mounted on the apparatus, it is possible to practice another option, for instance, multiple paper feeding by additional arrangement of another cassette.

Further, since the paper discharging tray 102 and the third cassette 71 are used as common component, the apparatus can be used ecomonically with the minimized number of components required therefor.

It should of course be understood that the present invention should not be limited only to the above-described embodiment. Alternatively, the apparatus may be constructed as illustrated in FIGS. 16 to 19. In the drawings reference numerals 83 designates a guide which is in communication with the paper discharging passage 77 in the thermal transfer type printer unit 122. A gate 84 is turnably disposed in the junction area between the guide 83 and the paper discharging passage 77 so that paper $P_3$ discharged from the printer is selectively introduced into the paper discharging passage 77 or the guide 83 in dependence on the position of the gate 84. A pair of feeding rollers 85 are disposed midway of the guide 83 so that paper $P_3$ is delivered to a document feeder 86 on the original holding board 104 by actuating the feeding rollers 85. The document feeder 86 is constituted by a combination of feeding rollers 87 and conveyor belt 88.

The control section 91 includes a multi-mode button 89 in addition to the copying mode button 92 and the printer mode button 93 and it is electrically connected to a driving control circuit 90 via the total control circuit 14.

When the multi-mode button 89 is turned on, paper $P_3$ to which image has been already transferred in the thermal transfer printer 122 is delivered to the guide 83 via the gate 84 and it is then transported to the document feeder 86 by means of the feeding rollers 85. Thus, paper $P_3$ is set on the original holding board 104 with the aid of the document feeder 86 and thereafter the copying machine is operated so that image on paper $P_3$ is exposed to build latent image on the photosentive drum 108. This latent image is developed in contact with developing agent in the developer 112 and thus developed image is transferred to paper $P_1$ or $P_2$ delivered from the first or second cassette 103*a* or 103*b*. Paper $P_1$ or $P_2$ is conveyed to the fixing device 119 to fix image therein and it is then discharged onto the paper discharging tray 102.

According to the last mentioned embodiment paper $P_3$ which image transference has been completed in the thermal transfer type printer 122 is automatically placed on the original holding board 104 without time-consuming consuming operation for transferring image on paper $P_3$ to paper $P_1$ or $P_2$.

Figure 19:
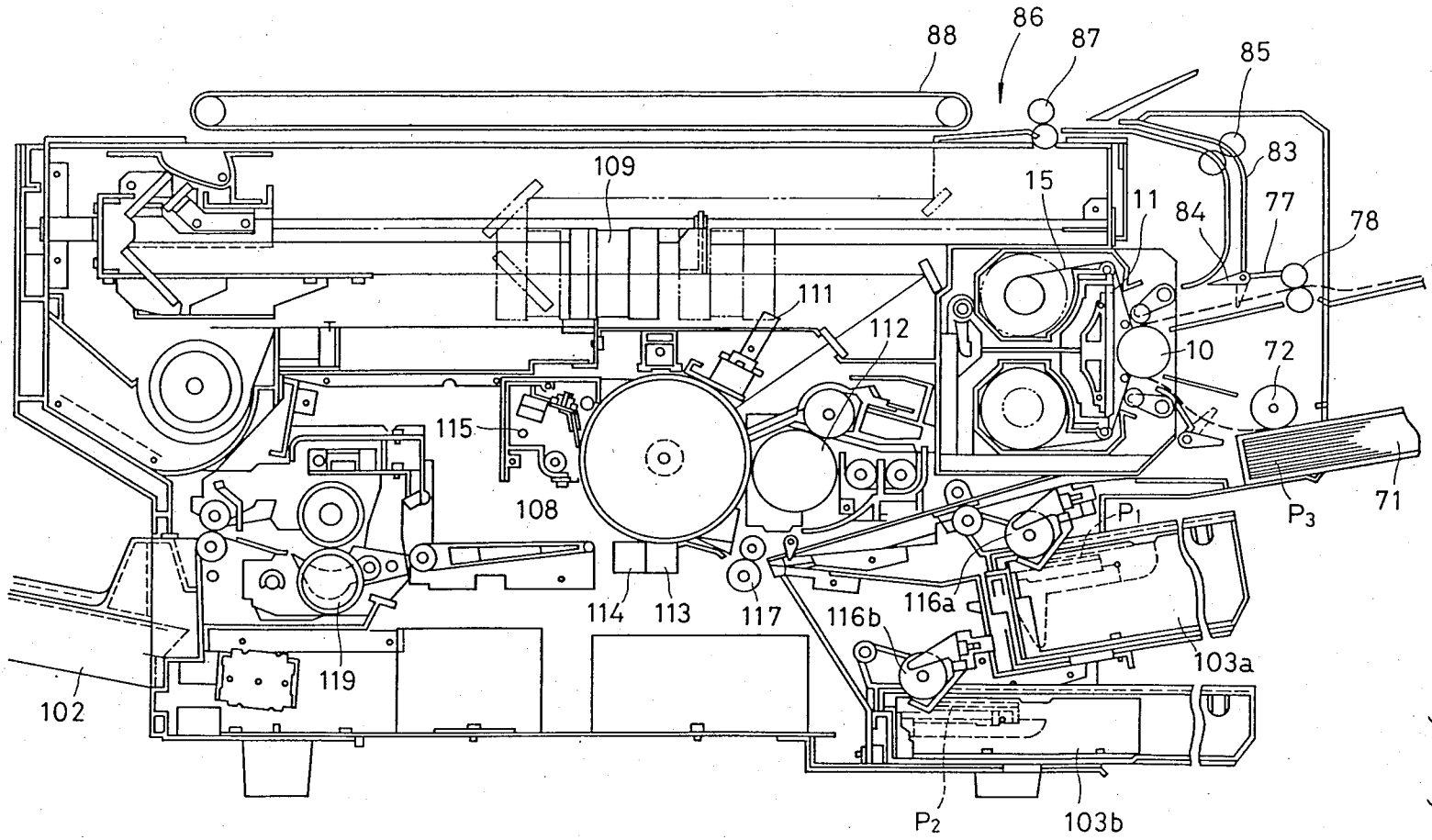

It should be noted that when the printing mode button 93 is turned on, the gate 84 is turned to the position as identified by real lines in FIG. 19 and paper $P_3$ with image transferred thereto is discharged onto the paper discharging tray 76.

What is claimed is:

1. An apparatus for transferring an image onto sheet-shaped material, comprising:

a housing;

storage means, attached to said housing, for storing a plurality of sheets of said sheet-shaped material;

an original holding surface on which an original is placed;

a discharging tray connected to said housing;

copying means, mounted within said housing, for copying an image of the original placed on said original holding surface onto said sheets, said copying means including a photosensitive body, means for forming a latent image corresponding to said image of said original on said photosensitive body, means for developing said latent image, and means for transferring said developed latent image to said sheets;

printing means, mounted within said housing, for printing an information-based image onto said sheets in response to image information, said printing means including at least one coloring agent and means for transferring said coloring agent onto said sheets to form said information-based image on said sheets;

feeding means for selectively feeding said sheets from said storage means to either said copying means or said printing means;

conveying means for selectively conveying a sheet onto which said information-based image has been printed by said printing means either to said original holding surface or to said discharging tray; and control means for controlling said copying means, printing means, feeding means, and conveying means so as to perform a printing-copying operation in which copying is carried out by said copying means using as said original a sheet having an information-based image formed in said printing means and being conveyed to said original holding surface by said conveying means.

2. The apparatus as defined in claim 1, wherein said printing means is detachably attached to said housing.

3. The apparatus as defined in claim 1, wherein said storage means is detachably attached to said housing.

4. The apparatus as defined in claim 1, wherein said printing means is of the thermal transfer type, said coloring agent is a heat-fusible coloring agent, and said transfer means includes a thermal head.

5. An apparatus for transferring an image onto sheet-shaped material, comprising:

a housing;

first storage means, attached to said housing, for storing a plurality of sheets of said sheet-shaped material;

second storage means, attached to said housing, for storing a plurality of sheets of said sheet-shaped material;

an original holding surface on which an original is placed;

copying means, mounted within said housing, for copying an image of the original placed on said original holding board onto said sheets stored in said first and second storage means, said copying means including a photosensitive body, means for forming a latent image corresponding to said image of said original on said photosensitive body, means for developing said latent image, and means for transferring said developed latent image to said sheets;

printing means, mounted within said housing, for printing an information-based image onto said sheets stored in said first storage means in response to image information, said printing means including at least one coloring agent and means for transferring said coloring agent onto said sheets to form said information-based image on said sheets;

feeding means for selectively feeding said sheets stored in said first storage means to either said copying means or to said printing means and for feeding said sheets stored in said second storage means to said copying means;

conveying means for conveying a sheet onto which said information-based image has been printed by said printing means to said original holding surface; and control means for controlling said copying means, printing means, feeding means, and conveying means so as to perform a printing-copying operation in which copying is carried out by said copying means using as said original a sheet having an information-based image formed in said printing means and being conveyed to said original holding surface by said conveying means.

6. The apparatus as defined in claim 5, wherein said printing means is detachably attached to said housing.

7. The apparatus as defined in claim 5, wherein said first and second storage means are detachably attached to said housing.

8. The apparatus as defined in claim 1, wherein said printing means is of the thermal transfer type.

9. An image building apparatus comprising:

a housing;

an original holding surface on which an original is placed;

first image forming means, mounted within said housing and including a photosensitive body, for forming onto said photosensitive body a latent image of an original located on said original holding surface, developing said latent image, and transferring said developed latent image to a sheet of sheet-shaped material;

second image forming means, mounted within said housing, for transferring a coloring agent forming an information-based image onto a sheet of sheet-shaped material in response to image information;

third image forming means for conveying to said original holding surface a first sheet of sheet-shaped material to which an information-based image has been transferred by said second image forming means, forming a latent image of said first sheet placed on said original holding surface onto said photosensitve body of said first image forming means, developing said latent image, and transferring said latent image to a second sheet of sheet-shaped material; and mode shifting means for selectively operating one of said first, second, or third image forming means.

* * * * *